United States Patent [19]

Moore

[11] Patent Number: 4,673,336

[45] Date of Patent: Jun. 16, 1987

[54] DIAPHRAGM GAS PUMP

[76] Inventor: James D. Moore, 1823 Border Ave., Torrance, Calif. 90501

[21] Appl. No.: 847,478

[22] Filed: Apr. 3, 1986

[51] Int. Cl.[4] ..... F04B 19/00; F04B 37/00; F04B 43/00; F04B 45/00

[52] U.S. Cl. ..... 417/239; 417/413; 417/454

[58] Field of Search ..... 417/413, 239, 238, 454, 417/395

[56] References Cited

U.S. PATENT DOCUMENTS

| | | | |
|---|---|---|---|
| Re. 31,711 | 10/1984 | Horiuchi | 417/222 |
| 1,737,388 | 11/1929 | Redmond | 417/413 |
| 2,144,662 | 1/1939 | Paasche | 417/413 |
| 2,203,479 | 6/1940 | Witwer et al. | 417/413 |
| 2,669,176 | 2/1954 | Lazerus | 417/239 |
| 3,195,808 | 7/1965 | Holt | 417/239 |
| 3,947,156 | 3/1976 | Becker | 417/413 |

FOREIGN PATENT DOCUMENTS

| | | | |
|---|---|---|---|
| 395504 | 5/1924 | Fed. Rep. of Germany | 417/413 |
| 3438982 | 5/1985 | Fed. Rep. of Germany | 417/413 |

*Primary Examiner*—Carlton R. Croyle
*Assistant Examiner*—Donald E. Stout
*Attorney, Agent, or Firm*—Lee W. Tower

[57] ABSTRACT

An oil free diaphragm gas pump for providing compressed gas and a gas vacuum is disclosed and includes a pressure tank, a concave pressure bulkhead, a first circular flange mounted on the pressure bulkhead and having a bevel on its inner edge, a round rigid diaphragm with an undulated circumferential periphery with its edge mounted on the bevel of the first circular flange, a round flexible diaphragm with an undulated circumferential periphery which matches the shape of the round rigid diaphragm and is mounted on the round rigid diaphragm, a second circular flange which together with the first circular flange presses together the flexible diaphragm and the rigid diaphragm, a prime mover for the purpose of moving the flexible diaphragm, and interchangable compressor and vacuum cartridge means alternately mounted between the diaphragms and the pressure tank for providing switching means for controlling the gas flow required for providing a compressor and a vacuum.

18 Claims, 10 Drawing Figures

FIG. 1
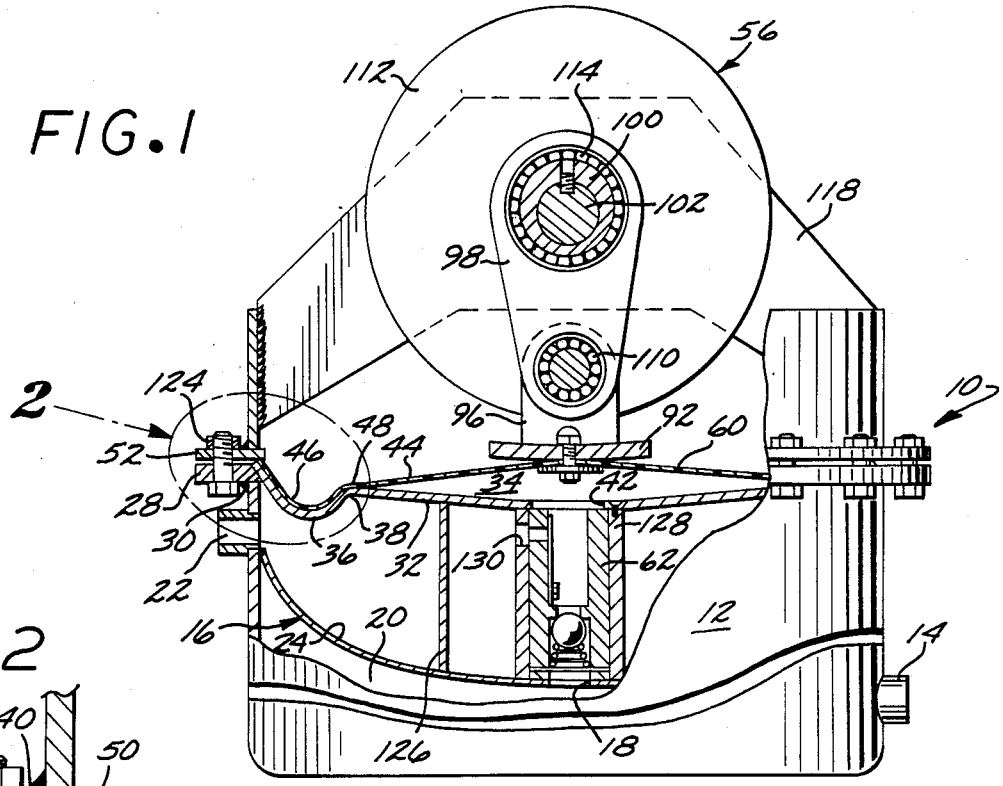
FIG. 2
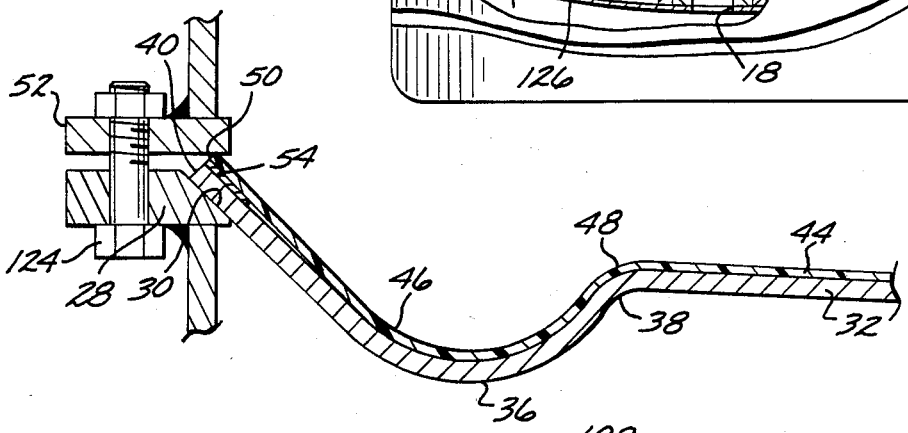
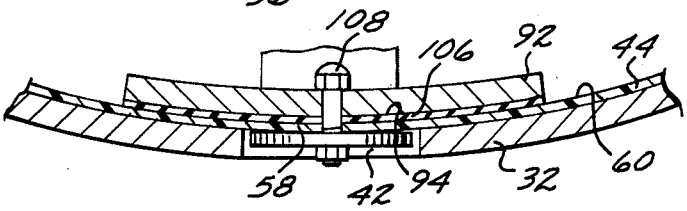
FIG. 3A
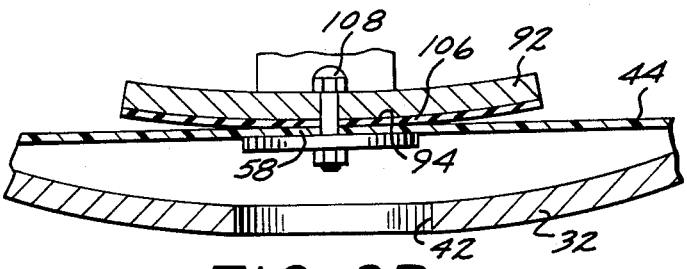
FIG. 3B

4C

4C

DIAPHRAGM GAS PUMP

BACKGROUND OF THE INVENTION

1. Field of the Invention

The disclosed invention relates to gas compressor pumps and gas vacuum pumps, and is particularly directed to a design which uses metal or composite diaphrams to either compress gas or provide a vacuum in an oil free environment.

2. Prior Art

Air compressors producing about 125 to 250 pounds per square inch (psi) pressure are common industrial equipment. Most of these compressors are designed with reciprocating pistons which must be lubricated with oil to operate. The result is that oil inevitably gets into the compressed air and there are many applications for which this is unacceptable. There are compressors that provide oil free compressed air. These compressors are designed with pistons, cylinders and rings that have special coatings such as teflon for lubricating the moving parts. These oil free air compressors have low life times due to the sliding parts which eventually wear away the special coatings. Another disadvantage of the piston type compressors is that they generate substantial noise. This is due to the relatively high speed at which they must operate to provide a certain volume of air.

Another method of obtaining compressed air is the use of diaphrams. For low air pressures, pumps have been designed using diaphrams formed of elastomeric materials such as rubber. U.S. Pat. No. 2,109,718 is an example of such an air compressor. At higher pressures these elastomeric diaphrams break down due to the high temperatures produced at high pressure.

Metal diaphrams have been proposed for certain uses, such as in U.S. Pat. No. 3, 036,526, which discloses a metal diaphram pump for liquids. U.S. Pat. No. 3,503,307 discloses the use of a metal diaphram for a pressure reducing valve. U.S. Pat. No. 3,508,471 applies a metal diaphram to a positive expulsion device and U.S. Pat. No. 3,036,526 uses a metal diaphram for pumping slurry. Other patents such as U.S. Pat. No. 4,136,603 disclose a particular diaphram assembly for use in highly corrosive applications. A key feature of metal or composite diaphrams is their ability to withstand high temperatures. Composite diaphrams are generally more flexible than metal diaphrams.

SUMMARY OF THE INVENTION

The diaphram gas pump of the present invention provides oil free compression and an oil free vacuum with greater reliability and longevity than the present piston type oil free compressors. The use of a metal or composite diaphram allows this design to achieve the 125 to 250 psi required for industrial use. It is another object of this invention to provide a compressor and vacuum for industrial use that is significantly quieter than the present piston type compressors. The lack of any sliding parts in the present invention vastly increases its longevity over the piston type compressors.

The diaphram gas pump has as its basic elements a pressure tank, a concave pressure bulkhead, a round rigid diaphram, a round flexible diaphram, special flanges to retain the diaphrams and a prime mover to pump the flexible diaphram. To form an oil free gas compressor, a compressor cartridge means is coupled between the pressure tank and the diaphrams. Alternately, to form an oil free vacuum, a vacuum cartridge means is substituted for the compressor cartridge means between the pressure tank and the diaphrams. To withstand the high temperatures developed while compressing air to 125–250 psi, the rigid diaphram is constructed of metal, and the flexible diaphram is constructed of metal or composite materials. In order that the metal or composite flexible diaphram operate over a long period without failure, the design of the flexible diaphram and the method of mounting it are very important. In the present invention, the rigid and flexible diaphrams have undulated peripheries, which provide stress relief. Special flanges retain the flexible diaphram in contact with the rigid diaphram without the need for any holes through the edge of the diaphrams for bolts, thereby avoiding focal points of stress. A specially contoured washer helps prevent unwanted deformation of the flexible diaphram as it is moved by the prime mover.

The use of interchangeable cartridges to obtain either a compressor or a vacuum is another object of the present invention. The interchangeable cartridges extend the usefulness of the machine and are designed to be easily exchanged by simple assembly techniques.

BRIEF DESCRIPTION OF THE DRAWINGS

The advantages and features of the disclosed invention will readily be appreciated by persons skilled in the art from the following detailed description when read in conjunction with the drawings wherein:

FIG. 1 is a longitudinal section view of a diaphram gas pump made in accordance with the principles of the present invention showing a compressor cartridge in place.

FIG. 2 is a sectional detailed view of the intersection of the diaphrams and the first and second circular flanges.

FIG. 3A is a sectional detailed view of the contoured washer and the diaphrams when the rigid and flexible diaphrams are compressed together.

FIG. 3B is a sectional detailed view of the contoured washer and the diaphrams when the rigid and flexible diaphrams are pulled apart.

DETAILED DESCRIPTION

Figure 4A:
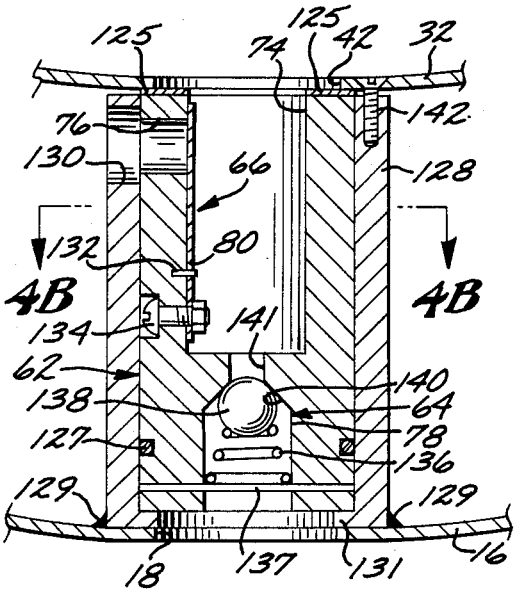
FIG. 4A is a detailed sectional view of the compressor cartridge.

Before explaining the invention in detail, it is to be understood that the invention is not limited in its application to the details of construction and the arrangements of the components set forth in the following description or illustrated in the drawings. The invention is capable of other embodiments and of being practiced and carried out in various ways. Also, in the following detailed description and in the several figures of drawings, like elements are identified with like reference numerals.

Referring now to FIG. 1, the numeral 10 generally designates a diaphram gas pump made in accordance with the principles of the present invention. The diaphram gas pump 10 includes pressure tank 12, concave pressure bulkhead 16, first circular flange 28, round rigid diaphram 32, round flexible diaphram 44, second circular flange 52, prime mover 56, and cylindrical compressor cartridge 62. The purpose of pressure tank 12 is to hold a volume of compressed air. The concave pressure bulkhead 16 closes the pressure tank on one end. The round rigid diaphram 32 and the round flexible diaphram 44 provide means for achieving compression or a vacuum. The first circular flange 28 and second circular flange 52 provide means for retaining diaphrams 32 and 44. The prime mover 56 can be of many forms, but essentially provides the required power to move the flexible diaphram 44 relative to the rigid diaphram 32. The cylindrical compressor cartridge 62 provides the switching means to control the flow of noncompressed air from the ambient atmosphere to the volume between the diaphrams and finally to the pressure tank. The outlet for the compressed air from the pressure tank is the pressure tank outlet 14.

As shown in FIG. 1, cylindrical compressor cartridge 62 is mounted between the rigid diaphram 32 and concave pressure bulkhead 16. Rigid diaphram 32 has a round hole 42 in its center that is concentric with a round hole 18 in the center of the concave pressure bulkhead. Concentric with rigid diaphram hole 42 and concave pressure bulkhead hole 18 is cylindrical sleeve 128 that provides structural support between the rigid diaphram and the pressure bulkhead and also provides a sleeve into which compressor cartridge 62 fits. Additional structural support is provided between the rigid diaphram and the concave pressure bulkhead by periodic placement of stiffeners as represented by stiffener 126. In the side of cylindrical sleeve 128 there is a hole 130 that communicates from the cylindrical compressor cartridge 62 to the volume between the rigid diaphram 32 and the concave pressure bulkhead 16. This latter volume is at low air pressure due to the direct communication via vent 22 to the ambient atmosphere.

The rigid diaphram, shown in FIG. 1, has an undulated circumferential periphery 36. This undulation begins at the interior circular boundary 38 of the rigid diaphram and continues to the edge of the diaphram. The flexible diaphram 44 also has an undulated circumferential periphery 46 which begins at the interior circular boundary 48 and continues to the edge of the flexible diaphram.

On the side of the flexible diaphram facing away from the rigid diaphram is mounted a round washer disc 92, which has the purpose of providing form factor support to the center area of flexible diaphram 44 as it is moved by the prime mover from a position away from the rigid diaphram to a position in close proximity to the rigid diaphram.

The center of the flexible diaphram is connected to connecting clevis 96, which is coupled to connecting rod 98 via first sealed antifriction bearing 110. Connecting rod 98 is coupled to drive shaft 102 via eccentric bushing 100 and second antifriction bearing 114. Flywheel 112 is mounted on drive shaft 102 and the drive shaft is turned by any suitable power source. The whole prime mover is mounted on mounting plates 118.

FIG. 2 shows the mounting of the flexible diaphram 44 on the rigid diaphram 32 via the first circular flange 28 and the second circular flange 52. As shown, the rigid diaphram has an undulated circumferential periphery 36, which begins its undulation at an interior circular boundary 38 and ends at rigid diaphram edge 40. Similarly the flexible diaphram has an undulated circumferential periphery 46, which begins its undulation at an interior circular boundary 48 and ends at flexible diaphram edge 50. There is a continuous circular high temperature diaphram gasket 54 between the two diaphrams to seal in the compressed air between the diaphrams.

First circular flange 28 has a circular bevel 30 with an angle that matches the angle of the rigid diaphram undulation where it makes contact with the bevel. The flexible diaphram, diaphram gasket 54 and the rigid diaphram are pressed together between bevel 30 of the first circular flange and the second circular flange 52. This is accomplished by bolts 124 fastened between the first circular flange 28 and second circular flange 52 around their periphery. No gaskets are required between the rigid diaphram and the first circular flange 28 or between the flexible diaphram and the second circular flange 52, because only ambient atmospheric pressure is at these interfaces. The method of mounting the diaphrams on the flanges holds the edges of the diaphrams still, while the undulation in the peripheries of the diaphrams permits the flexible diaphram to flex when its center is being moved from a position away from the rigid diaphram to a position in close proximity to the rigid diaphram.

FIG. 3A and FIG. 3B show the center 58 of the flexible diaphram 44 in close proximity to the rigid diaphram 32 and in a position away from the rigid diaphram, respectively. As shown, there is a contoured round washer disc 92 mounted on side 60 of the flexible diaphram facing away from the rigid diaphram and fastened there by bolt 108. The side of the contoured round washer disc facing the flexible diaphram has the same contour as the contour of the corresponding area of the rigid diaphram facing the flexible diaphram. This design has the purpose of maintaining the proper shape of the flexible diaphram over its lifetime. Without the contoured round washer disc, there would be a tendency for the flexible diaphram to contort in this area over a period of time and the result would be a decrease in compression capacity. An abrasion resistant gasket 106 is mounted between the round washer disc and the flexible diaphram. This abrasion resistant gasket can be made from a material such as Torlon (a registered trademark of Amoco).

FIG. 4A illustrates how the cylindrical compressor cartridge 62 is mounted between hole 42 in rigid diaphram 32 and hole 18 in the concave pressure bulkhead. The hollow cylindrical sleeve 128 is welded around base 129 to the concave pressure bulkhead. During assembly the compressor cartridge is slid into cylindrical sleeve 128 until in contact with cylindrical sleeve lip 131. O-ring 127 provides a seal between the compressor cartridge and the cylindrical sleeve. After the compressor cartridge is slid in, the assembly is continued by mounting high temperature gasket 125 onto the compressor cartridge and then mounting the rigid diaphram 32 over the gasket and securing the rigid diaphram to the cylindrical sleeve by screw 142.

Figure 4B:
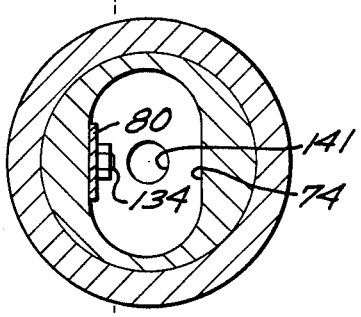
FIG. 4B is a sectional view along line 4B—4B of FIG. 4A showing the oblong bore in the compressor cartridge.

The compressor cartridge has a first switching means 64, whose purpose is to open and close a communication path from the volume between the diaphrams to the pressure tank. As shown in FIG. 4B, the compressor cartridge has oblong bore 74 that extends from the compressor cartridge end facing the flexible diaphram partially through the length of the compressor cartridge. The oblong bore communicates via circular bore 141 to compressor cartridge first switching means 64 that consists of ball check valve 78, which comprises ball 138, spring 136, bevel bore 140, and retainer pin 137.

Figure 4C:
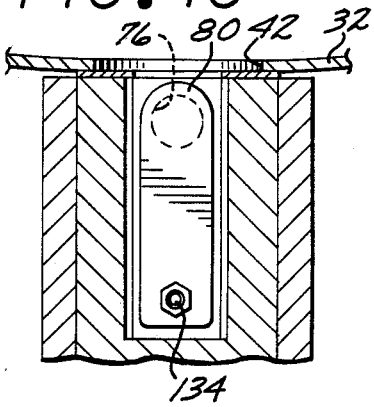
FIG. 4C is a sectional view along line 4C—4C of FIG. 4B showing the reed valve in the compressor cartridge.

The compressor cartridge also has a second switching means 66 that is for the purpose of opening and closing a communication path from the ambient atmosphere pressure to the volume between the diaphrams. As described above, the oblong bore communicates to the volume between the diaphrams. Referring to FIG. 4A, 4B, and 4C, the second switching means consists of reed valve 80, which is attached along the flat side of the oblong bore by bolt 134 and guided by guide 132. The reed valve controls communication from the oblong bore through hole 76 in the cylindrical compressor cartridge wall, which in turn communicates to the ambient atmosphere via hole 130 in the cylindrical sleeve and vent 22.

The compressor cartridge operates in the following manner. When the flexible diaphram is moved from a position away from the rigid diaphram to a position in close proximity to the rigid diaphram, a positive pressure relative to the ambient atmosphere is developed in the volume between the flexible and rigid diaphrams and thereby in the oblong bore 74 of the compressor cartridge. This positive pressure closes the second switching means, the reed valve, and opens the second switching means, the ball check valve, if the developed pressure is also positive relative to the pressure inside the pressure tank. Thus, compressed air is forced into the pressure tank. Alternately, when the flexible diaphram is moved from a position in close proximity to the rigid diaphram to a position away from the rigid diaphram, a negative pressure develops in the volume between the diaphrams relative to the pressure in the pressure tank, allowing spring 136 to close the ball check valve, and the resulting vacuum that develops as the flexible diaphram moves further away from the rigid diaphram, causes the reed valve to open. Thus, the volume between the diaphrams is filled with ambient pressure air. On the next cycle this air is compressed and enters the pressure tank.

Figure 5A:
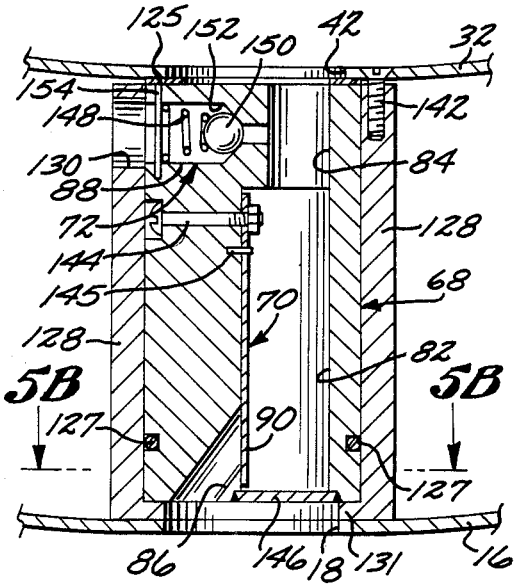
FIG. 5A is a detailed sectional view of the vacuum cartridge.
Figure 5B:
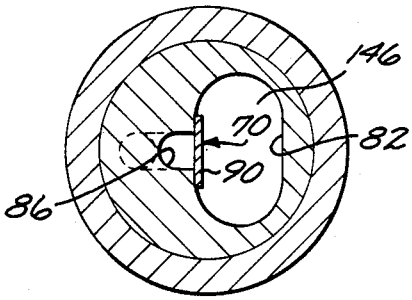
FIG. 5B is a sectional view along line 5B—5B of FIG. 5A showing the angular and oblong bores in the vacuum cartridge.

The oil free diaphram gas pump can be transformed from an air compressor to a vacuum by the substitution of a vacuum cartridge for the compressor cartridge heretofore described. FIG. 5A, and 5B describe such a cylindrical vacuum cartridge 68. It has the same exterior form factor as the cylindrical compressor cartridge 62. This allows it to be inserted instead of the cylindrical compressor cartridge into the cylindrical sleeve 128. As in the case of the compressor cartridge, it is slid into the cylindrical sleeve until it rests on the cylindrical sleeve lip 131. O-ring 127 provides a seal between the vacuum cartridge and the cylindrical sleeve. After the vacuum cartridge is slid in, the assembly is continued by mounting a high temperature gasket 125 onto the vacuum cartridge and then mounting the rigid diaphram 32 over the gasket and securing the rigid diaphram to the cylindrical sleeve by screw 142.

The vacuum cartridge has a first switching means 70 that is for the purpose of opening and closing a communication path from the volume between the diaphrams via the oblong bore 82, shown in FIG. 5A and FIG. 5B, to the pressure tank. The first switching means consists of reed valve 90, which is attached along the flat side of the oblong bore by bolt 144 and guided by guide 145. The reed valve controls communication from the oblong bore through angular bore 86 which communicates to the pressure tank. Plug 146 blocks direct communication between oblong bore 82 and the pressure tank.

The vacuum cartridge also has a second switching means 72, whose purpose is to open and close a communication path from the volume between the diaphrams to the ambient atmosphere. The second switching means consists of ball check valve 88, which comprises ball 150, spring 148, bevel bore 152 and retainer pin 154. The ball check valve communicates to the ambient atmosphere via hole 130 in the cylindrical sleeve and vent 22. To provide space for the ball check valve, the oblong bore 82 communicates to circular bore 84, which communicates to the ball check valve and the volume between the diaphrams.

The vacuum cartridge operates in the following manner. When the flexible diaphram is moved from a position away from the rigid diaphram to a position in close proximity to the rigid diaphram, a positive pressure relative to the pressure tank pressure is developed in the volume between the flexible and rigid diaphrams and thereby in the oblong bore 82 of the vacuum cartridge. This positive pressure closes the first switching means 70, the reed valve 90, and opens the second switching means 72, the ball check valve 88. Thus, any air in the volume between the diaphrams is forced to exit via the ball check valve, hole 130 and vent 22 to the ambient atmosphere. Alternately, when the flexible diaphram is moved from a position in close proximity to the rigid diaphram to a position away from the rigid diaphram, a negative pressure develops in the volume between the diaphrams relative to the pressure in the pressure tank, allowing the first switching means 70, reed valve 90, to open and simultaneously to allow spring 136 to close the second switching means 72, the ball check valve 88, and as the flexible diaphram moves further away from the rigid diaphram air is drawn from the pressure tank into the volume between the diaphrams. On the next cycle this air is expelled to the atmosphere and the cycle repeats. Thus, the pressure tank is evacuated causing a vacuum.

The ability to use one device to achieve both an oil free compressed gas source and a vacuum device vastly increases the usefulness of this machine.

Figure 6:
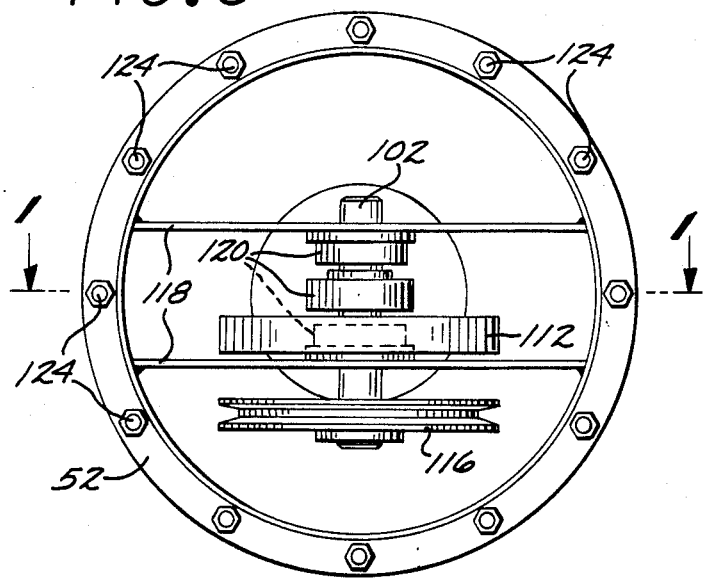
FIG. 6 is an top elevation view of the diaphram gas compressor of FIG. 1 showing the circular flange and the prime mover.

FIG. 6 shows the top view of the diaphram gas compressor. Shown are the first circular flange 52 and the flange bolts 124. Also shown is the prime mover 56 structure consisting of the prime mover mounting plates 118, the drive shaft 102, bearing housings 120, flywheel 112 and pulley 116. One bearing housing contains the antifriction bearing 114 and the eccentric bushing 100, which convert the rotating motion of the drive shaft to the reciprocating motion required to move the flexible diaphram. In the preferred embodiment, the diaphram gas pump is belt driven via the pulley. There are other prime mover devices that could be employed. Essentially all that is required is to have a prime mover with sufficient power and stroke to move the flexible diaphram between the limits of its cycle.

Although the foregoing has been a description and illustration of specific embodiments of the invention, various modifications and changes thereto can be made by persons skilled in the art without departing from the scope and spirit of the invention as defined by the following claims.

What is claimed is:

1. An oil free diaphram gas pump for providing compressed gas comprising:

a pressure tank having an outlet; and a concave pressure bulkhead connected to one end of said pressure tank and having a hole in its center communicating to the interior of said pressure tank and having a vent communicating to the ambient atmosphere; and a first circular flange mounted on said pressure bulkhead and having a bevel on its inner edge; and a round rigid diaphram mounted on said first circular flange thereby forming a flow pressure bulkhead volume between said pressure bulkhead and said rigid diaphram and wherein said round rigid diaphram has an undulated circumferential periphery, which at the edge of said periphery matches said bevel on said first circular flange and is flush with said bevel when said rigid diaphram is mounted on said first circular flange and wherein said rigid diaphram has a hole in its center concentric with said hole in said pressure bulkhead; and a round flexible diaphram mounted on said round rigid diaphram and wherein said round flexible diaphram has an undulated circumferential periphery which matches said undulated periphery on said round rigid diaphram; and a second circular flange fastened to said first circular flange making contact with the edge of said flexible diaphram thereby providing a means for pressing said flexible diaphram and said rigid diaphram together between said first and said second circular flanges; and a continuous diaphram gasket mounted between said undulated periphery of said flexible diaphram and said undulated periphery of said rigid diaphram; and a prime mover coupled to the center of said flexible diaphram for the purpose of moving a portion of said flexible diaphram from a position away from said rigid diaphram to a position in close proximity to said rigid diaphram wherein said portion of said flexible disphram extends from said interior circular boundary to said center of said flexible diaphram; and a cylindrical compressor cartridge means mounted between said hole in center of said rigid diaphram and said hole in center of said pressure bulkhead for providing a first switching means for controlling the opening and closing of a communication path between interior of said pressure tank and the volume between said rigid diaphram and said flexible diaphram and a second switching means for controlling the opening and closing of a communication path between said low pressure bulkhead volume and said volume between said rigid diaphram and said flexible diaphram wherein said first switching means closes and said second switching means opens when said prime mover moves said flexible diaphram away from said rigid diaphram and said first switching means opens and said second switching means closes when said prime mover moves said flexible diaphram toward said rigid diaphram.

2. An oil free diaphram gas pump for providing a gas vacuum comprising:

a pressure tank having an outlet; and a concave pressure bulkhead connected to one end of said pressure tank and having a hole in its center communicating to the interior of said pressure tank and having a vent communicating to the ambient atmosphere; and a first circular flange mounted on said pressure bulkhead and having a bevel on its inner edge; and a round rigid diaphram mounted on said first circular flange thereby forming a low pressure bulkhead volume between said pressure bulkhead and said rigid diaphram and wherein said round rigid diaphram has an undulated circumferential periphery, which at the edge of said periphery matches said bevel on said first circular flange and is flush with said bevel when said rigid diaphram is mounted on said first circular flange and wherein said rigid diaphram has a hole in its center concentric with said hole in said pressure bulkhead; and a round flexible diaphram mounted on said round rigid diaphram and wherein said round flexible diaphram has an undulated circumferential periphery which matches said undulated periphery on said round rigid diaphram; and a second circular flange fastened to said first circular flange making contact with the edge of said flexible diaphram thereby providing a means for pressing said flexible diaphram and said rigid diaphram together between said first and said second circular flanges; and a continuous diaphram gasket mounted between said undulated periphery of said flexible diaphram and said undulated periphery of said rigid diaphram; and a prime mover coupled to the center of said flexible diaphram for the purpose of moving a portion of said flexible diaphram from a position away from said rigid diaphram to a position in close proximity to said rigid diaphram wherein said portion of said flexible diaphram extends from said interior circular boundary to said center of said flexible diaphram; and a cylindrical vacuum cartridge means mounted between said hole in center of said rigid diaphram and said hole in center of said pressure bulkhead for providing a first switching means for controlling the opening and closing of a communication path between interior of said pressure tank and the volume between said rigid diaphram and said flexible diaphram and a second switching means for controlling the opening and closing of a communication path between said low pressure bulkhead volume and said volume between said rigid diaphram and said flexible diaphram wherein said first switching means opens and said second switching means closes when said prime mover moves said flexible diaphram away from said rigid diaphram and said first switching means closes and said second switching means opens when said prime mover moves said flexbible diaphram toward said rigid diaphram.

3. The oil free diaphram gas pump of claim 1 wherein said cylindrical compressor cartridge means for providing a first switching means for controlling the opening and closing of a communication path between the interior of said pressure tank and the volume between said rigid diaphram and said flexible diaphram and a second switching means for controlling the opening and closing of a communication path between said low pressure bulkhead volume and said volume between said rigid diaphram and said flexible diaphram comprises:

a cylindrical cartridge having an oblong bore part way through its center communicating to said volume between said flexible diaphram and said rigid diaphram and having a bore communicating from an elongated side of said oblong bore to said low pressure bulkhead volume; and a ball check valve communicating from said oblong bore to interior of said pressure tank wherein a positive pressure in said pressure tank relative to the pressure in said volume between said rigid and flexible diaphrams causes said ball check valve to close whereas a relative negative pressure causes said ball check valve to open; and a reed valve mounted over said bore communicating from said oblong bore to said low pressure bulkhead volume wherein a positive pressure in said volume between said rigid diaphram and said flexible diaphram relative to the pressure in said low pressure bulkhead volume causes said reed valve to close whereas a relative negative pressure causes said reed valve to open.

4. The oil free diaphram gas pump of claim 2 wherein said cylindrical vacuum cartridge means for providing a first switching means for controlling the opening and closing of a communication path between the interior of said pressure tank and the volume between said rigid diaphram and said flexible diaphram and a second switching means for controlling the opening and closing of a communication path between said low pressure bulkhead volume and said volume between said rigid diaphram and said flexible diaphram comprises:

a cylindrical cartridge having an oblong bore part way through its center communicating to a circular bore which communicates to said volume between said flexible diaphram and said rigid diaphram and having an angular bore communicating from an elongated side of said oblong bore to said pressure tank; and a reed valve mounted over said angular bore communicating from said oblong bore to interior of said pressure tank wherein a positive pressure in said volume between said rigid diaphram and said flexible diaphram relative to the pressure in said pressure causes said reed valve to close whereas a relative negative pressure causes said reed valve to open; and a ball check valve communicating from said circular bore to said low pressure bulkhead volume wherein a positive pressure in said volume between said rigid diaphram and said flexible diaphram relative to the pressure in the low pressure bulkhead volume causes said ball check valve to open whereas a relative negative pressure causes said ball check valve to close.

5. The oil free diaphram gas pump of claim 1 which further comprises:

a round washer disc having on one face the same contour as on the side of said rigid diaphram facing said flexible diaphram and mounted between said prime mover and said flexible diaphram with said contoured face facing said flexible diaphram for the purpose of guiding said flexible diaphram as said prime mover moves said flexible diaphram toward said rigid diaphram.

6. The oil free diaphram gas pump of claim 2 which further comprises:

a round washer disc having on one face the same contour as on the side of said rigid diaphram facing said flexible diaphram and mounted between said prime mover and said flexible diaphram with said contoured face facing said flexible diaphram for the purpose of guiding said flexible diaphram as said prime mover moves said flexible diaphram toward said rigid diaphram.

7. The oil free diaphram gas pump of claim 5 wherein said cylindrical compressor cartridge means for providing a first switching means for controlling the opening and closing of a communication path between the interior of said pressure tank and the volume between said rigid diaphram and said flexible diaphram and a second switching means for controlling the opening and closing of a communication path between said low pressure bulkhead volume and said volume between said rigid diaphram and said flexible diaphram comprises:

a cylindrical cartridge having an oblong bore part way through its center communicating to said volume between said flexible diaphram and said rigid diaphram and having a bore communicating from an elongated side of said oblong bore to said low pressure bulkhead volume; and a ball check valve communicating from said oblong bore to the interior of said pressure tank wherein a positive pressure in said pressure tank relative to the pressure in said volume between said rigid and flexible diaphrams causes said ball check valve to close whereas a relative negative pressure causes said ball check valve to open; and a reed valve mounted over said bore communicating from said oblong bore to said low pressure bulkhead volume wherein a positive pressure in said volume between said rigid diaphram and said flexible diaphram relative to the pressure in said low pressure bulkhead volume causes said reed valve to close whereas a relative negative pressure causes said reed valve to open.

8. The oil free diaphram gas pump of claim 6 wherein said cylindrical vacuum cartridge means for providing a first switching means for controlling the opening and closing of a communication path between the interior of said pressure tank and the volume between said rigid diaphram and said flexible diaphram and a second switching means for controlling the opening and closing of a communication path between said low pressure bulkhead volume and said volume between said rigid diaphram and said flexible diaphram comprises:

a cylindrical cartridge having an oblong bore part way through its center communicating to a circular bore which communicates to said volume between said flexible diaphram and said rigid diaphram and having an angular bore communicating from an elongated side of said oblong bore to said pressure tank; and a reed valve mounted over said angular bore communicating from said oblong bore to the interior of said pressure tank wherein a positive pressure in said volume between said rigid diaphram and said flexible diaphram relative to the pressure in said pressure causes said reed valve to close whereas a relative negative pressure causes said reed valve to open; and a ball check valve communicating from said circular bore to said low pressure bulkhead volume wherein a positive pressure in said volume between said rigid diaphram and said flexible diaphram relative to the pressure in the low pressure bulkhead volume causes said ball check valve to open whereas a relative negative pressure causes said ball check valve to close; and

9. The oil free diaphram gas pump of claim 7 wherein said prime mover further comprises:

a connecting clevis mounted to said flexible diaphram; and a connecting rod coupled to said connecting clevis; and an eccentric bushing mounted within said connecting rod; and a drive shaft mounted through said eccentric bushing-;and a power source driving said drive shaft.

10. The oil free diaphram gas pump of claim 8 wherein said prime mover further comprises:

a connecting clevis mounted to said flexible diaphram; and a connecting rod coupled to said connecting clevis; and an eccentric bushing mounted within said connecting rod; and a drive shaft mounted through said eccentric bushing-;and a power source driving said drive shaft.

11. An oil free diaphram gas pump for providing compressed gas and a gas vaccuum comprising:

a pressure tank havng an outlet; and a concave pressure bulkhead connected to one end of said pressure tank and having a hole in its center communicating to the interior of said pressure tank and having a vent communicating to the ambient atmosphere; and a first circular flange mounted on said pressure bulkhead and having a bevel on its inner edge; and a round rigid diaphram mounted on said first circular flange thereby forming a low pressure bulkhead volume between said pressure bulkhead and said rigid diaphram and wherein said round rigid diaphram has an undulated circumferential periphery, which at the edge of said periphery matches said bevel on said first circular flange and is flush with said bevel when said rigid diaphram is mounted on said first circular flange and wherein said rigid diaphram has a hole in its center concentric with said hole in said pressure bulkhead; and a round flexible diaphram mounted on said round rigid diaphram and wherein said round flexible diaphram has an undulated circumferential periphery which matches said undulated periphery on said round rigid diaphram; and a second circular flange fastened to said first circular flange making contact with the edge of said flexible diaphram thereby providing a means for pressing said flexible diaphram and said rigid diaphram together between said first and said second circular flanges; and a continuous diaphram gasket mounted between said undulated periphery of said flexible diaphram and said undulated periphery of said rigid diaphram; and a prime mover coupled to the center of said flexible diaphram for the purpose of moving a portion of said flexible diaphram from a position away from said rigid diaphram to a position in close proximity to said rigid diaphram wherein said portion of said flexible diaphram extends from said interior circular boundary to said center of said flexible diaphram; and interchangable compressor and vacuum cartridge means alternately mounted between said hole in center of said rigid diaphram and said hole in center of said pressure bulkhead wherein when said compressor cartridge means is installed there is provided a first switching means for controlling the opening and closing of a communication path between the interior of said pressure tank and the volume between said rigid diaphram and said flexible diaphram and a second switching means for controlling the opening and closing of a communication path between said low pressure bulkhead volume and said volume between said rigid diaphram and said flexible diaphram wherein said first switching means closes and said second switching means opens when said prime mover moves said flexible diaphram away from said rigid diaphram and said first switching means opens and said second switching means closes when said prime mover moves said flexible diaphram toward said rigid diaphram and when said vaccum cartridge means is installed there is provided a first switching means for controlling the opening and closing of a communication path between the interior of said pressure tank and the volume between said rigid diaphram and said flexible diaphram and a second switching means for controlling the opening and closing of a communication path between said low pressure bulkhead volume and said volume between said rigid diaphram and said flexible diaphram wherein said first switching means opens and said second switching means closes when said prime mover moves said flexible diaphram away from said rigid diaphram and said first switching means closes and said second switching means opens when said prime mover moves said flexible diaphram toward said rigid diaphram.

12. The oil free diaphram gas pump claim 11 which further comprises:

a round washer disc having on one face the same contour as on the side of said rigid diaphram facing said flexible diaphram and mounted between said prime mover and said flexible diaphram with said contoured face facing said flexible diaphram for the purpose of guiding said flexible diaphram as said prime mover moves said flexible diaphram toward said rigid diaphram.

13. The oil free diaphram gas pump of claim 11 wherein said cylindrical compressor cartridge means for providing a first switching means for controlling the opening and closing of a communication path between the interior of said pressure tank and the volume between said rigid diaphram and said flexible diaphram and a second switching means for controlling the opening and closing of a communication path between said low pressure bulkhead volume and said volume between said rigid diaphram and said flexible diaphram comprises:

a cylindrical cartridge having an oblong bore part way through its center communicating to said volume between said flexible diaphram and said rigid diaphram and having a bore communicating from an elongated side of said oblong bore to said low pressure bulkhead volume; and a ball check valve communicating from said oblong bore to the interior of said pressure tank wherein a positive pressure in said pressure tank relative to the pressure in said volume between said rigid and flexible diaphrams causes said ball check valve to close whereas a relative negative pressure causes said ball check valve to open; and a reed valve mounted over said bore communicating from said oblong bore to said low pressure bulkhead volume wherein a positive pressure in said volume between said rigid diaphram and said flexible diaphram relative to the pressure in said low pressure bulkhead volume causes said reed valve to close whereas a relative negative pressure causes said reed valve to open.

14. The oil free diaphram gas pump of claim 13 wherein said cylindrical vacuum cartridge means for providing a first switching means for controlling the opening and closing of a communication path between the interior of said pressure tank and the volume between said rigid diaphram and said flexible diaphram and a second switching means for controlling the opening and closing of a communication path between said low pressure bulkhead volume and said volume between said rigid diaphram and said flexible diaphram comprises:

a cylindrical cartridge having an oblong bore part way through its center communicating to a circular bore which communicates to said volume between said flexible diaphram and said rigid diaphram and having an angular bore communicating from an elongated side of said oblong bore to said pressure tank; and a reed valve mounted over said angular bore communicating from said oblong bore to the interior of said pressure tank wherein a positive pressure in said volume between said rigid diaphram and said flexible diaphram relative to the pressure in said pressure causes said reed valve to close whereas a relative negative pressure causes said reed valve to open; and a ball check valve communicating from said circular bore to said low pressure bulkhead volume wherein a positive pressure in said volume between said rigid diaphram and said flexible diaphram relative to the pressure in the low pressure bulkhead volume causes said ball check valve to open whereas a relative negative pressure causes said ball check valve to close.

15. The oil free diaphram gas pump of claim 12 wherein said cylindrical compressor cartridge means for providing a first switching means for controlling the opening and closing of a communication path between the interior of said pressure tank and the volume between said rigid diaphram and said flexible diaphram and a second switching means for controlling the opening and closing of a communication path between said low pressure bulkhead volume and said volume between said rigid diaphram and said flexible diaphram comprises:

a cylindrical cartridge having an oblong bore part way through its center communicating to said volume between said flexible diaphram and said rigid diaphram and having a bore communicating from an elongated side of said oblong bore to said low pressure bulkhead volume; and a ball check valve communicating from said oblong bore to the interior of said pressure tank wherein a positive pressure in said pressure tank relative to the pressure in said volume between said rigid and flexible diaphrams causes said ball check valve to close whereas a relative negative pressure causes said ball check valve to open; and a reed valve mounted over said bore communicating from said oblong bore to said low pressure bulkhead volume wherein a positive pressure in said volume between said rigid diaphram and said flexible diaphram relative to the pressure in said low pressure bulkhead volume causes said reed valve to close whereas a relative negative pressure causes said reed valve to open.

16. The oil free diaphram gas pump of claim 15 wherein said cylindrical vacuum cartridge means for providing a first switching means for controlling the opening and closing of a communication path between the interior of said pressure tank and the volume between said rigid diaphram and said flexible diaphram and a second switching means for controlling the opening and closing of a communication path between said low pressure bulkhead volume and said volume between said rigid diaphram and said flexible diaphram comprises:

a cylindrical cartridge having an oblong bore part way through its center communicating to a circular bore which communicates to said volume between said flexible diaphram and said rigid diaphram and having an angular bore communicating from an elongated side of said oblong bore to said pressure tank; and a reed valve mounted over said angular bore communicating from said oblong bore to the interior of said pressure tank wherein a positive pressure in said volume between said rigid diaphram and said flexible diaphram relative to the pressure in said pressure causes said reed valve to close whereas a relative negative pressure causes said reed valve to open; and a ball check valve communicating from said circular bore to said low pressure bulkhead volume wherein a positive pressure in said volume between said rigid diaphram and said flexible diaphram relative to the pressure in the low pressure bulkhead volume causes said ball check valve to open whereas a relative negative pressure causes said ball check valve to close.

17. The oil free diaphram gas pump of claim 14 wherein said prime mover further comprises:

a connecting clevis mounted to said flexible diaphram; and a connecting rod coupled to said connecting clevis; and an eccentric bushing mounted within said connecting rod; and a drive shaft mounted through said eccentric bushing-;and a power source driving said drive shaft.

18. The oil free diaphram gas pump of claim 16 wherein said prime mover further comprises:

a connecting clevis mounted to said flexible diaphram; and a connecting rod coupled to said connecting clevis; and an eccentric bushing mounted within said connecting rod; and a drive shaft mounted through said eccentric bushing-;and a power source driving said drive shaft.

* * * * *